US007913739B2

(12) United States Patent
Rejc et al.

(10) Patent No.: US 7,913,739 B2
(45) Date of Patent: Mar. 29, 2011

(54) HIGH-SPEED INDUSTRIAL ROLLER DOOR

(75) Inventors: Gabrijel Rejc, Landshut (DE); Matjaz Sentjurc, Velen (SI); Joze Breznikar, Vrhnika (SI)

(73) Assignee: Efaflex Inzeniring D.O.O. Ljubljana, Ljubljana (SK)

( * ) Notice: Subject to any disclaimer, the term of this patent is extended or adjusted under 35 U.S.C. 154(b) by 226 days.

(21) Appl. No.: 12/089,815

(22) PCT Filed: Oct. 16, 2006

(86) PCT No.: PCT/EP2006/009974
§ 371 (c)(1),
(2), (4) Date: Jun. 26, 2008

(87) PCT Pub. No.: WO2007/045423
PCT Pub. Date: Apr. 26, 2007

(65) Prior Publication Data

US 2008/0251220 A1 Oct. 16, 2008

(30) Foreign Application Priority Data

Oct. 17, 2005 (DE) ..... 10 2005 049 584

(51) Int. Cl.
*E06B 9/08* (2006.01)

(52) U.S. Cl. ..... 160/133; 160/191; 160/238

(58) Field of Classification Search ..... 160/133, 160/191, 192, 193, 265, 238
See application file for complete search history.

(56) References Cited

U.S. PATENT DOCUMENTS 812,722 A 2/1906 Cahill
1,183,402 A 5/1916 Prescott
2,912,048 A * 11/1959 Grau ..... 160/133
(Continued)

FOREIGN PATENT DOCUMENTS

DE 255 647 10/1911
(Continued)

OTHER PUBLICATIONS

International Search Report for PCT/EP2006/009974, mailed Jan. 4, 2007.

(Continued)

*Primary Examiner* — Blair M. Johnson
(74) *Attorney, Agent, or Firm* — Nixon & Vanderhye PC

(57) ABSTRACT

A high-speed industrial roller door includes a door leaf that is guided in lateral guides and a drive that acts on the door leaf to displace the latter from an open position into a closed position and vice versa. The door leaf is held in the open position so that adjacent areas of the door leaf are not in contact with one another, in a spiral section of the lateral guides located in the vicinity of the door lintel. The roller door also includes a weight compensation device. The drive has two extension arms that are coupled via joints to the lintel end of the door leaf, said arms being situated at a distance from one another across the door width and being synchronously pivoted about a pivoting axis in a central area of the spiral section. The distance between the coupling points of the extension arms on the door leaf and the pivoting axis of the extension arms can be varied. This permits the provision of a roller door with a drive that is situated near the door lintel, for which the degree of potential damage during a collision with the door leaf is reduced in relation to prior arrangements.

15 Claims, 10 Drawing Sheets

U.S. PATENT DOCUMENTS

| | | | | | |
|---|---|---|---|---|---|
| 3,092,170 | A | | 6/1963 | Ellis | |
| 3,095,922 | A | | 7/1963 | Frazier | |
| 4,565,231 | A | * | 1/1986 | Moessner et al. | 160/133 |
| 4,947,937 | A | | 8/1990 | Searer et al. | |
| 5,484,007 | A | | 1/1996 | Rejc | |
| 5,488,982 | A | * | 2/1996 | Rejc | 160/133 |
| 5,632,317 | A | | 5/1997 | Krupke et al. | |
| 5,682,937 | A | | 11/1997 | Decrane et al. | |
| 5,996,670 | A | | 12/1999 | Igarashi | |
| 6,085,825 | A | * | 7/2000 | Swink et al. | 160/188 |
| 6,119,758 | A | | 9/2000 | Coenraets | |
| 6,766,845 | B2 | * | 7/2004 | Rejc | 160/133 |
| 6,883,577 | B2 | * | 4/2005 | Frede | 160/133 |
| 2003/0047291 | A1 | * | 3/2003 | Klein | 160/133 |
| 2005/0115688 | A1 | | 6/2005 | Frede | |
| 2006/0231215 | A1 | * | 10/2006 | Loo | 160/133 |
| 2008/0295411 | A1 | | 12/2008 | Rejc | |

FOREIGN PATENT DOCUMENTS

| | | | | |
|---|---|---|---|---|
| DE | 39 04 224 | A1 | | 8/1990 |
| DE | 40 15 214 | A1 | | 11/1991 |
| DE | 40 15 215 | | | 11/1991 |
| DE | 298 04 411 | U1 | | 7/1998 |
| FR | 2584216 | | * | 6/1985 |
| NL | 10 16 983 | | | 2/2002 |
| WO | 95/30064 | | | 11/1995 |

OTHER PUBLICATIONS

German-language Examination Report of DE 102005049584.2, dated Sep. 21, 2006.

German-language International Preliminary Report on Patentability with Annex pages, completed Jan. 9, 2008.

Translation of the International Preliminary Report on Patentability for PCT/EP2006/009974.

International Search Report re PCT/EP2006/009973 dated Jan. 18, 2007.

Examination Report re DE 10 2005 049 585.0 dated Sep. 19, 2006.

Notice of Allowance re U.S. Appl. No. 12/083,356 dated May 27, 2010.

* cited by examiner

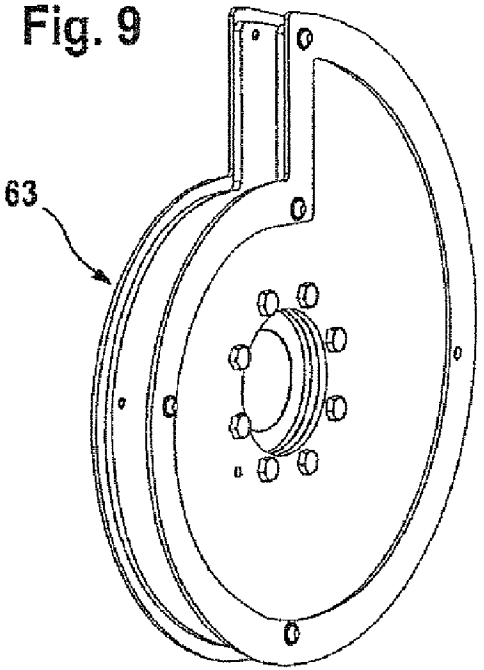
Fig. 9
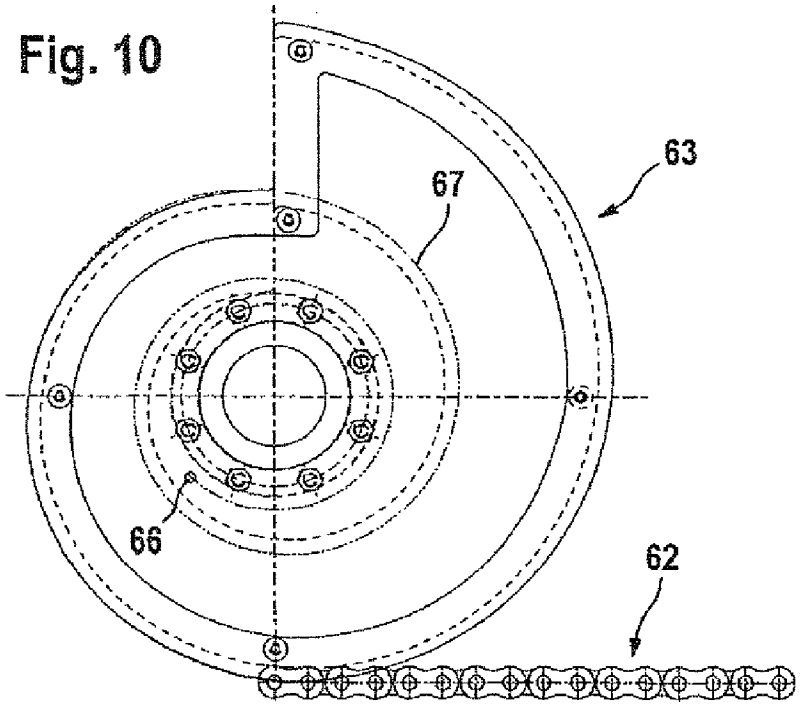
Fig. 10
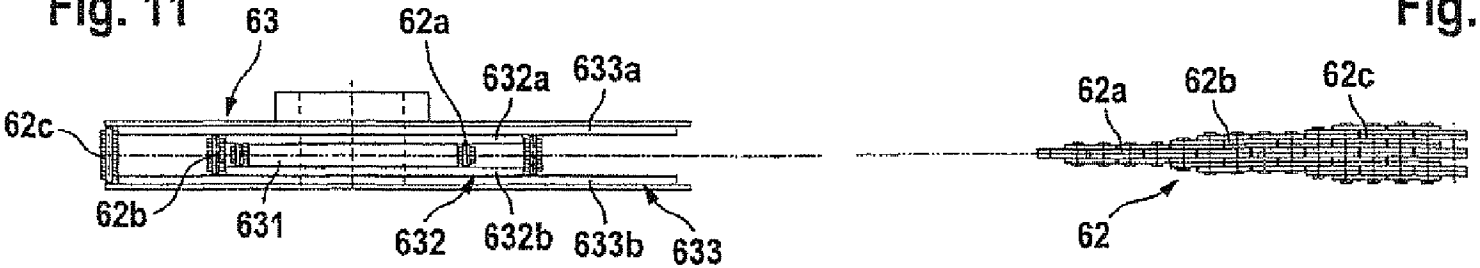
Fig. 11
Fig. 12

HIGH-SPEED INDUSTRIAL ROLLER DOOR

This application is the U.S. national phase of International Application No. PCT/EP2006/009974, filed 16 Oct. 2006, which designated the U.S. and claims priority to DE 10 2005 049 584.2, filed 17 Oct. 2005, the entire contents of each of which are hereby incorporated by reference.

RELATED APPLICATION

This application is related to copending, commonly assigned (now allowed) U.S. application Ser. No. 12/083,356 filed Apr. 10, 2008, entitled WEIGHT COMPENSATION DEVICE FOR A LIFTING DOOR which names Messrs Rejc, Sentjurc and Breznikar as joint inventors.

BACKGROUND

1. Technical Field

The exemplary embodiment relates to a high-speed industrial roller door having a door leaf which covers the door opening and which is guided in lateral guides, a drive which acts on the door leaf in order to move it from an open position into a closed position and vice versa, wherein in the open position the door leaf is accommodated in a spiral section, arranged in the vicinity of the door lintel, of the lateral guides in such a way that adjacent areas of the door leaf are not in contact with one another, and having a weight compensation device.

2. Related Art

In practical applications, roller doors are known in a wide variety of embodiments. A comparatively simple design of such a roller door is one in which a flexible curtain is wound onto a winding shaft in the vicinity of the door lintel in the course of the opening movement of the roller door. The lintel-side end of the flexible door leaf is, for this purpose, secured to the winding shaft and in the course of the opening movement a continuously growing roll of layers of the curtain is created, wherein these layers can come to rest directly one on the other. Such roller doors have gained widespread acceptance in practice and are often used since they are cost-effective to make available and have a comparatively low weight, which has advantageous effects on energy consumption.

However, a disadvantage of this type of roller door is that the windings of the door leaf which are embodied as a curtain become scratched and soiled after only a comparatively short time owing to the direct mutual contact between them in the roll. This applies equally to roller doors having slatted armor instead of a flexible curtain, as is also known from practical applications.

For specific applications and in particular for high-speed operation with a speed of movement of more than one meter per second, the practice of guiding the door leaf in a contactless manner in the vicinity of the lintel of the door opening has been adopted. Examples of such roller doors can be found, inter alia, in DE 40 15 215 A1, DE 199 15 376 A1 and DE 102 36 648 A1. In these designs, the door leaf, irrespective of whether it is slatted armor or a flexible curtain etc., is guided in lateral guide rails which open in the vicinity of the door lintel above the door opening into a spiral section in which the door leaf is guided in an elongated or approximately round roll.

In contrast to the roller doors explained at the beginning with a curtain which is wound directly onto a winding shaft, when there is contactless guidance the roll does not build up from the inside to the outside but rather from the outside to the inside, that is to say the leading, that is to say lintel-side, end of the door leaf runs increasingly further into a central area of the spiral section in the course of the opening movement of the roller door.

Such roller doors are distinguished by outstanding properties so that they have also gained acceptance particularly in industrial applications. In particular, they permit a reliable and durable door closure to be manufactured with which very high speeds of movement of up to four meters per second are possible.

On the other hand, this method of guiding a door leaf in the roll requires entirely new drive equipment since these designs have made the winding shaft itself vulnerable. Although the drive motor in these roller doors is still arranged in the region of the door lintel for reasons of space, the application of the drive force to the door leaf occurs at the floor end. In the embodiments which are customary at present, the drive motor usually acts via a toothed belt on drive rollers in the form of toothed belt pulleys which are arranged on each side of the door, also in the vicinity of the door lintel, and each in turn act via a toothed belt on a strap or the like which is rigidly coupled on both sides to the floor end of the door leaf. The two lateral toothed belts are fixedly connected to the straps or the like in this context so that the rotational movement of the drive motor ultimately causes the door leaf to be raised or lowered.

In particular in the case of door leaves which are embodied as slatted armor, it has also become acceptable practice in this context if a weight compensation device is provided which serves to balance the weight of the door leaf of a lifting door. This weight compensation device typically has spring elements which are under maximum prestress when the door is closed, and therefore support the opening movement of the door leaf. However, this not only reduces the drive torques necessary for the activation of such a lifting door but also, given correct adjustment of the arrangement, prevents the door leaf from dropping suddenly in the event of a fault.

In practical applications, high-speed industrial doors with weight compensation devices of a design such as is explained, for example, in WO 91/18178 have become widespread. Such a weight compensation device typically, has as the spring element, a helical spring and a tensile element which is attached thereto and is generally in the form of a belt. The lower end of the tensile element is in this context fixedly connected to the floor while its upper end is coupled by the tensile element to a winding shaft which is arranged at the lintel side of the lifting door. In this context, in the course of the closing process of the lifting door the tensile element is wound onto this winding shaft with layers which rest directly one on the other so that the spring element is increasingly stressed. On the other hand, the opening movement of the door leaf is associated with an unwinding process of the tensile element from the winding shaft so that in this context the stress of the spring element is released. The winding shaft is coupled to the drive of the lifting door here.

This method of driving a roller door has also been proven in practical application for many years. However, the elements of the drive mechanism are subject to a considerable risk of damage if the door leaf coincides with another object.

In this context it is necessary to take into account the fact that the floor-side end of a door leaf is particularly at risk in terms of collisions. Such collisions may occur, for example, if a forklift truck driver incorrectly estimates the speed of movement of the door leaf and sets his vehicle in motion too early in the course of the opening movement of the door leaf. Further sources of danger frequently occur if large-side goods are transported which restrict the field of vision. Such collisions then usually result in a deformed or broken closure element of the door leaf, and at the same time the lateral straps or the like of the drive mechanism which are present in the lateral guides may also be damaged.

In order to counter this problem, the applicant has developed an active crash system which, in the event of a collision, permits the lower section of the door leaf to be deflected out of the plane of the door leaf as soon as a predetermined value of a lateral force is exceeded. This development has also given rise to the roller door with collision protection which is described in German patent application DE 103 42 302 A1. With this system it is possible very largely to avoid the damage to the door leaf which adversely affects the functioning of the roller door. Furthermore, the risk of damage to the elements of the drive mechanism can also be considerably reduced in this way since as soon as the door leaf is deflected in the central area of the door opening the straps etc. which are present in the lateral frames are freed of the loading which usually occurs in said central area of the door opening.

Despite the considerable advantages in practical application, this specific roller door with the active crash system is subject to the problem that when the door leaf is deflected there is no longer a closure element present which brings about a transverse connection between the two lateral guide devices. The points of an engagement for the application of the drive force to the door leaf are therefore no longer supported on one another in the event of a collision, which causes tilting moments to occur in the lateral guides. Even if these tilting moments can be limited by correspondingly precise guide elements, this nevertheless results in increased wear and constitutes a considerable additional cost factor. Furthermore, in unfavorable cases it is still impossible to prevent the coupling points for the drive force from also being damaged in the event of a collision, for example if a collision occurs directly adjacent to the lateral frames.

BRIEF SUMMARY

The exemplary embodiment is therefore based on the object of developing a high-speed industrial roller door of the generic type in such a way that the degree of possible consequential damage in the event of a collision with the door leaf can be reduced.

This object is achieved by means of a high-speed industrial roller door having the features of claim 1. Said roller door is distinguished in particular by the fact that the drive has at least two extension arms by means of which it is coupled in an articulated manner to a lintel-side end of the door leaf, wherein the extension arms are arranged spaced apart from one another in the width of the door and can be pivoted synchronously about a pivoting axis in a central area of the spiral section, and wherein the distance between coupling points of the extension arms on the door leaf and the pivoting axis of the extension arms can be varied.

The exemplary embodiment therefore provides for the first time that, in an industrial roller door with a door leaf which is wound in a contact free manner in the open position, the drive force is applied to the lintel-side end of the door leaf. Although the distance between the lintel-side end of the door leaf and the center of the spiral changes continuously in the course of the opening movement of the door leaf, the inventive method of driving the door leaf according to the exemplary embodiment can be implemented reliably since a corresponding length compensation means is provided on the extension airs.

The industrial roller door according to the exemplary embodiment is distinguished here by the advantage, which is very considerable in practice, that the entire drive equipment of the door leaf can be placed in the lintel area of the door opening and is therefore positioned in a way which is essentially protected in particular against collisions. As a result, there can be a significant overall reduction in the degree of damage in the event of a collision compared to conventional roller doors.

Furthermore, the industrial roller door according to the exemplary embodiment can also be restored to a state in which it is ready for use in a significantly shorter time and with significantly lower expenditure if damage occurs to the door leaf since only individual lamellas or sections of curtain without a direct connection to the drive have to be replaced.

In addition, by virtue of the extension arms which are arranged spaced apart firm one another in the width of the door, reliable application of the drive force to the door leaf continues to be achieved even if roller doors with relatively large widths of, for example, six meters and more are present.

It is also advantageous that the roller door according to the exemplary embodiment has a weight compensation device. By virtue of such a weight compensation device, such as is already customary per se, prestress is used to ensure that a smaller drive force is necessary to open the door leaf than if such a weight compensation means were not provided. In this context, it should be taken into account that during the opening movement the door leaf has to be pulled upward counter to the force of gravity in order to be taken into the spiral section in the door lintel. This movement is assisted by the weight compensation device by means of spring prestress which is applied to the door arrangement in the course of the closing movement of the door leaf.

Within the scope of the exemplary embodiment, the application of such a weight compensation device has in particular the advantage that the necessary drive force can be significantly reduced when the effective lever length on the extension arms is at a maximum, specifically at the start of the opening movement. With increasing progress of the opening movement, the assistance effect is reduced by the force compensation device but at the same time the effective lever arm at the extension arm is also shortened since the lintel-side end of the door leaf moves increasingly into the central area of the door section. As a result, according to the exemplary embodiment, the energy which is expended on this movement can be kept particularly low while at the same time the stressing of the components of the drive is lower. This results overall in a higher level of reliability and longer service life of the door arrangement. In addition, it permits particularly high speeds of movement to be achieved.

By virtue of the fact that the extension arms can be pivoted synchronously with one another about a pivoting axis in a central area of the spiral section, the door leaf is reliably prevented from tilting in the guides during the movement. As a result, the roller door according to the exemplary embodiment can be operated very reliably and at high speed.

By virtue of the fact that the extension arms can be pivoted synchronously with one another about a pivoting axis in a central area of the spiral section, the door leaf is reliably prevented from tilting in the guides during the movement. As a result, the roller door according to the invention can be operated very reliably and at high speed.

The variability of the effective lever length at the extension arms also permits the changing of radius in the course of the spiral to be allowed for. In combination with the articulated coupling method, tilting or excessive frictional loading of the door leaf in the spiral section can therefore be reliably avoided.

It is also advantageous that the previously customary toothed belts, chains or the like for transmitting the drive force from the motor which is arranged in the lintel to the floor-side closure plate of the door leaf are dispensed with. According to the exemplary embodiment, this reduces the space which is required in the lateral frames, as a result of which they can be made narrower. Furthermore, according to the exemplary embodiment, there are fewer elements, on which dirt etc. could collect, in the vicinity of the lateral frames. In this context, in particular the conventionally used toothed belts with their large number of teeth have hitherto been problematic, especially if the roller door has been used in the pharmaceutical field or in clean rooms. In these specific fields of application, the possibility of thoroughly cleaning the roller door is of considerable importance. The simplified configuration of the door arrangement which is achieved according to the exemplary embodiment allows for this so that the roller door according to the exemplary embodiment is specifically also particularly well suited to these application purposes.

A further advantage of the industrial roller door according to the exemplary embodiment is that by dispensing with the toothed belts, chains or the like for transmitting force a relatively high level of reliability can be achieved since these elements constitute parts which are subject to wear. The industrial roller door according to the exemplary embodiment is therefore distinguished by particularly low maintenance requirements and a high level of reliability accompanied by a long service life.

Furthermore, said industrial roller door provides a higher level of safety than conventional roller doors since risk factors such as, for example, unintentional dropping of the door leaf if toothed belts tear, are eliminated according to the exemplary embodiment.

In addition, said industrial roller door has a particularly simple design since the door leaf is simply guided in the lateral frames and can be free of lateral connections.

In this context the Dutch patents NL 1015953 and NL 1016983 have disclosed a roller blind for closing off a window opening in a building, and on first sight said roller blind contains similar system elements. This roller blind has a slatted armor which is guided in lateral guides and which can be moved by means of a drive from an open position into a closed position and vice versa. The slatted armor is held here in the open position in a spiral section of the lateral guides which is arranged in the vicinity of the opening lintel, in such a way that adjacent areas of the armor are not in contact with one another. In addition, the drive has two extension arms which are mounted in a drive shaft and by means of which said drive can be coupled rigidly to a lintel-side end of the slatted armor. The extension arms are arranged spaced apart from one another in the width of the door and can be pivoted synchronously in a pivoting axis in a central area of the spiral section by means of the drive shaft. In addition, the distance between the coupling points of the extension arms on the door leaf and the pivoting axis of the extension arms can be varied.

The principle which is shown in these documents can be applied to roller blinds which are driven manually or by motor at low speeds if there is sufficient room for angular movements of the individual lamellas in the guides; however, said principle can not in any way be used in high-speed industrial roller doors since the high dynamic loads which occur on these blown roller blinds during high-speed operation would be impossible to cope with. In this context it is necessary, for example, to take into account the fact that the rigid coupling of the extension arms to the uppermost lamella of the roller blind does not take into account the angular position of this last lamella with respect to the drive shaft, which changes continuously in the spiral section. In order to prevent this uppermost lamella tilting even at low speeds of movement, a guide with a large degree of play is therefore necessary. At high speeds of movement of more than one meter per second, such as are customary in high-speed industrial roller doors, deformations also occur to the lamellas owing to the change in dynamic loads, and said deformation would lead to uncontrollable movement states given such loose guidance in the lateral guides.

Furthermore, with these known roller blinds there is also no provision of a weight compensation device, neither is one necessary since the dimensions of the opening in a building which is to be closed are generally very small and therefore only a small weight has to be moved at a low speed. Accordingly, in the prior art only comparatively small torques also act on the extension arms. In the case of an industrial roller door which is operated at high speed, completely different force conditions apply here, and in particular the weight compensation device is reliably able to cope with such force conditions.

Documents NL 1015953 and NL 1016983 therefore describe an arrangement which is not suitable for high-speed operation and use for closing off door openings in industrial buildings. Furthermore, these documents do not contain any suggestion whatsoever to couple the extension arms to the lintel-side end of the door leaf in an articulated manner or to make available a weight compensation device. In addition, such roller blinds are also not subject to collision problems, such as generally occur with industrial roller doors which are subject to high frequency of use. To this extent, they also could not make any suggestion with regard to solving the problem of interest.

Advantageous developments of the industrial roller door according to the exemplary embodiment are the subject matter of the dependant claims.

The extension alms may therefore be of telescopic design, as a result of which the value of the effective distance between the coupling points of the extension arms to the door leaf and the pivoting axis of the extension arms can be varied with a particularly simple structural means. It is therefore easily possible to allow for the radii which change continuously in the spiral when the lintel-side end of the door leaf is inserted into the spiral section.

It is possible in this context for the telescopic extension arms each to contain a tubular guide part and a piston part which is guided therein in a freely displaceable manner. As a result of the free displaceability of the piston part, each extension arm can then be adapted automatically to the variable radius in the spiral section without an active effect, for example for the purpose of controlling the effective length, being necessary for this purpose on the extension arms. It is therefore possible to obtain a particularly simple design which is advantageously distinguished by a low degree of expenditure on maintenance, a high level of reliability and low provision costs.

It is also advantageous if the extension arms are arranged on a common drive shaft which is driven in rotation by a motor of the drive. Simple structural means than can be used to produce a reliable synchronous movement of the extension arms about their pivoting axis. In addition, this also does not increase the space required for the drive of the industrial roller door according to the invention since the drive shaft can be arranged in the usually open central area of the spiral section, that is to say it does not require any significant installation space outside the movement area of the door leaf which is defined by the spiral section. In addition, interruption during operation of the industrial roller door can also be reliably avoided since, for example, according to the invention a toothed belt cannot jump by a tooth since the toothed belts are eliminated, and such jumping cannot occur in all arrangement of the two extension arms on a common drive shaft.

If the motor drives the drive shaft directly it is also possible to implement an even more reliable and simple design for the industrial roller door according to the invention. In particular, this permits a chain, a toothed belt or the like for the transmission of the drive force from the motor to the drive shaft to be avoided, as a result of which the number of components of the drive overall is reduced and at the same time greater durability compared to the prior art can be achieved. Preferably an angular motor is used for this in order to reduce the space which is required.

In addition, the extension arms can be coupled to an element which extends over the entire width of the door. Compared to the design as per DE 103 42 302 A1, which uses the active crash system, the advantage then arises that the drive force which is applied to at least two points acts on an element which extends continuously in the transverse direction of the door opening so that tilting moments, as in the deflected door leaf in this prior art, can be avoided. As a result, the expenditure on the necessary lateral guides at the floor-side end of the door leaf can be reduced significantly compared to the prior art. The structural expenditure on the roller door according to the invention is therefore significantly smaller than in the prior art. At the same time, within the scope of the invention it is also possible to make advantageous use of a door leaf with a deflectable central area, as in DE 103 42 302 A1, in order to avoid damage to the door leaf.

It is also advantageous if the door leaf has two lateral hinge belts which are each arranged adjacent to the guides, wherein the extension arms are each coupled to lintel-side end sections of the hinge belts. Such hinge belts are known, for example, from DE 40 15 215 A1, which is cited at the beginning, and they are used to reliably take up the loads which occur during the opening movement or closing movement, and to keep the door closing element such as the slatted armor or a curtain, which is fastened hereto, essentially free of these loads. The direct interaction of the extension arms with these hinge belts allows the forces which are necessary for the movement to be applied to such a door leaf in an optimum way. As a result, the risk of damage to the door leaf can be kept particularly low by virtue of the dynamic stresses.

If the lintel-side end sections of the hinge belts can be adjusted in length viewed in the direction of movement of the door leaf, it is possible for tolerance compensation to be carried out in the arrangement using simple means in order in this way to achieve the most precise possible vertical orientation of the door leaf. The problem of possible oblique positioning of the door leaf, for example owing to extension arms which do not quite project at the same angle, with the associated risk of tilting of the door leaf in the lateral guides can therefore be effectively eliminated.

It is also advantageous if the weight compensation device has a spring element, a tensile element and a winding device, wherein one end of the spring element can be secured to the floor, wherein the tensile element is attached by one end to the spring element and by the other end to the winding device, wherein the winding device can be coupled to a drive of the roller door or lifting door, wherein the tensile element can be wound onto the winding device and unwound from it in such a way that the spring element has its highest degree of prestress when a door leaf of the lifting door is in the closed position, and is essentially relieved of stress when the door leaf is in the open position. The tensile element has a smaller width at the end facing the winding device than at the end facing the spring element, and wherein the winding device has a shaft and a guide device which is mounted thereon and by means of which the tensile element can be wound up in such a way that the winding layers are not in contact with one another, wherein, for this purpose, the guide device has, on the circumference, guide faces with a radius which increases continuously in the winding direction.

It is therefore possible for the first time to wind on the tensile element in a contactless manner, as a result of which the torques which are necessary for effective weight compensation can be made available with little structural expenditure, and an increased service life is achieved.

This results automatically in radii in the roll which are increased by the contact free winding, for which reason a small number of revolutions of the winding device is already sufficient to produce the desired prestress of the spring element. Since this is advantageous in particular in the case of door leaves which are guided in the roller in a contactless manner since only a reduced number of rotational movements of the drive shaft also occur here compared to conventional door leaves which are wound in a contact-forming fashion. According to the invention it is therefore generally possible to dispense with additional speed-changing gear mechanisms etc. and to also drive the weight compensation device directly through the drive shaft for the door leaf. The design of a lifting door which is equipped with this weight compensation device can therefore be made simple in structural terms.

This is in turn advantageous with respect to reduced wear and an improved service life of such a lifting door.

In addition, the larger radii which are therefore present in the roll result in larger lever lengths, which in turn results in larger torques than with conventional, contact-forming winding of the tensile element. The weight compensation device can therefore also be used advantageously in very large and heavy doors.

In addition, the configuration according to the exemplary embodiment has the advantage that the selection of the effective radius or of the effective lever length on the guide device can be made independent of the thickness of the tensile element since all that is required for this are correspondingly configured guide faces to be formed on the guide device. As a result, a person skilled in the art can individually adapt the weight compensation to the respective dimensions of the lifting door leaf and to its weight solely through selective shaping of the guide device without having to take into account, for example, the thickness of the tensile element, the core diameter of a winding shaft etc. for this purpose.

A further advantage of this weight compensation device is that owing to its specific configuration the tensile element can be wound on free of axial displacement. As a result, one-sided loading on the tensile element can be avoided and the wear of said element which is particularly stressed during use can therefore be kept small. This has an advantageous effect on the service life of the weight compensation device.

In this context it has already been known from WO 2004/076795 A1 to configure the door leaf of a lifting door in such a way that that it has a smaller width at the lintel-side end than at the floor-side end. In addition, from this document it is known to provide two modules which are spaced apart axially and on which the door leaf can be wound in a contactless manner, wherein the two modules have on the circumference guide faces with a radius which increases continuously in the winding direction. However, this configuration relates exclusively to a possibility of winding on a door leaf in a contactless manner and thus avoiding scratching or damage thereof. With respect to weight compensation, this document refers to the conventional configuration which is explained above and which has a helical spring and a tensile belt and in which the tensile belt is wound onto a winding shaft in a contact-forming fashion. This document does not contain any suggestion to provide contactless winding of the tensile belt of the weight compensation means instead or in addition to the door leaf. In addition, WO 2004/076795 A1 does not concern itself in the slightest with the problems of setting a suitable weight compensation characteristic on such a lifting door.

In addition, the width of the tensile element can be increased incrementally from the end facing the winding device to the end facing the spring element, wherein the guide device has at least two guide sections which are each embodied in the form of a spiral and are axially offset with respect to one another in such a way that a pair of outer guide sections adjoins an inner guide section, the minimum guide face of radius of said pair of outer guide sections corresponding to the maximum guide face radius of the inner guide section. As a result, an advantageous arrangement can be implemented with comparatively little structural expenditure since the guide faces on each guide section have to be made available only in one plane. At the point at which the inner guide section can no longer provide the corresponding, spiral-shaped guide face, that is to say after one complete revolution, according to the exemplary embodiment, a pair of axially outer guide sections with an adapted radius performs the further guide function in conjunction with a correspondingly adapted wider section of the tensile element. With this configuration, it is already possible to implement two complete revolutions of the guide device with a radius which increases continuously in the winding direction, which is sufficient for many applications. If more than two revolutions of the guide device are necessary, further pairs of outer guide sections may be adjoined and these are correspondingly embodied and in turn interact with a still wider section of the tensile element.

As an alternative to this it is also possible that the width of the tensile element increases continuously from the end facing the winding device to the end facing the spring element, and in that the guide device has two guide spirals which, starting from a central section, extend axially further apart from one another toward the outside with an increasing radius. As a result, contact-free winding of the tensile element is also possible, but a three-dimensional configuration of the guide faces is necessary for this. However, this configuration also permits the guide faces to be made available with a radius which increases continuously in the winding direction.

If the tensile element is a chain, a stable configuration, which is nevertheless very flexible in the winding direction, of this component of the weight compensation device can be made available. In particular, such a chain has a very high tensile strength, for which reason it can be applied particularly advantageously to lifting doors with large dimensions of for example, 8 m in width and 6 m in height.

Alternatively it is also possible for the tensile element to be embodied as a belt. This configuration is particularly advantageous if the width of the tensile element increases continuously from the end facing the winding device to the end facing the spring element since such an embodiment can be implemented more easily in fabrication terms with a belt than with a chain. For example metal or plastic and here, in particular, fiber-reinforced plastics are possible as the material for such a belt.

It is also advantageous if the spring element has at least one helical spring. Compared to other spring-elastic elements which per se can certainly also be used, helical springs have already gained acceptance to a large extent in practice with known weight compensation devices owing to the robustness and reliability of helical springs. In addition, with such helical springs it is easily possible to make available the desired spring properties.

In this context it is also advantageous if the guide device is mounted on the drive shaft on which the extension arms are also arranged. It is then possible to achieve a particularly compact and robust design since a separate drive is not necessary for the weight compensation device or transmission elements such as the toothed belt or the like.

BRIEF DESCRIPTION OF THE DRAWINGS

The invention will be explained in more detail below in exemplary embodiments with reference to the figures in the drawing, in which:

FIG. 9 shows a perspective view of a guide device of the weight compensation device;

FIG. 10 shows a side view of the guide device according to FIG. 9 with a schematic illustration of the movement path of the tensile element;

FIG. 11 shows a plan view of this guide device;

FIG. 12 shows a plan view of the tensile element; and

DETAILED DESCRIPTION OF EXEMPLARY EMBODIMENTS

Figure 1:
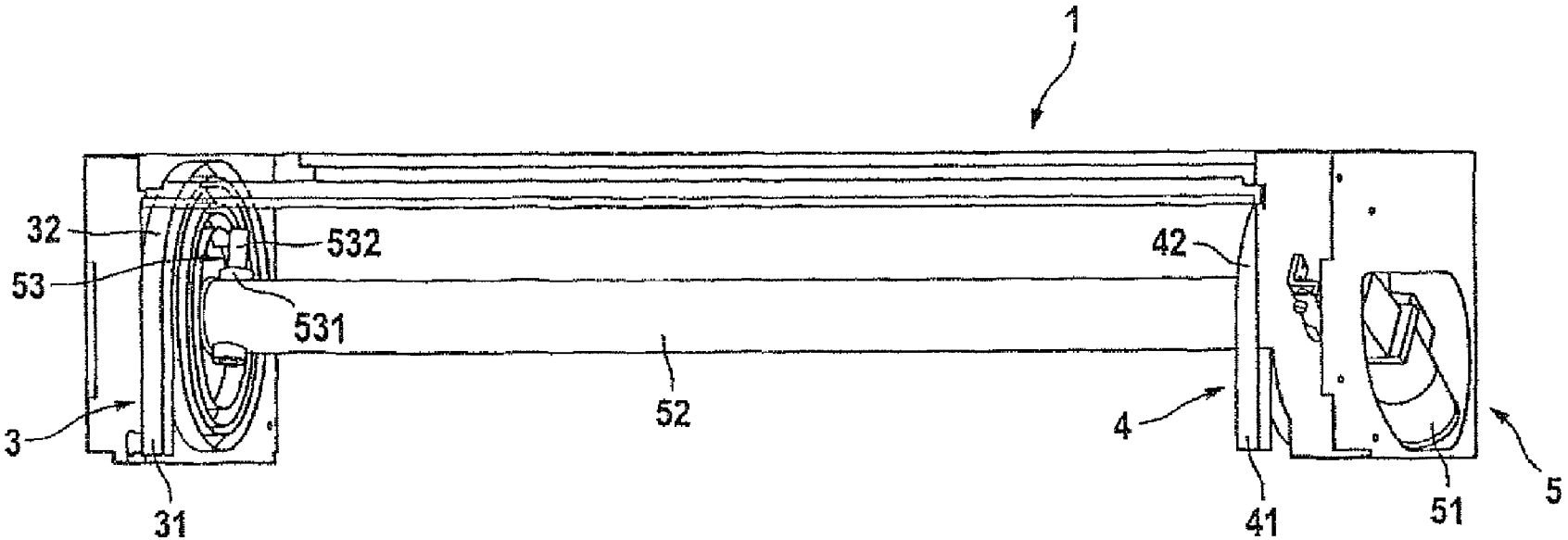
FIG. 1 is a perspective view of an industrial roller door according to the exemplary embodiment, clarifying the drive mechanism in the lintel area of the door opening.

According to the illustration in the figures, an industrial roller door, referred to below for short as roller door 1, has a door leaf 2 which has lamellas 21 which are coupled to one another in an articulated manner and are guided in lateral guides 3 and 4 by means of rollers 22. The rollers 22 are mounted here on lateral hinge belts 23 which take up the tensile loads and thrust loads on the door leaf 2 and hold the lamellas 21.

Figure 2:
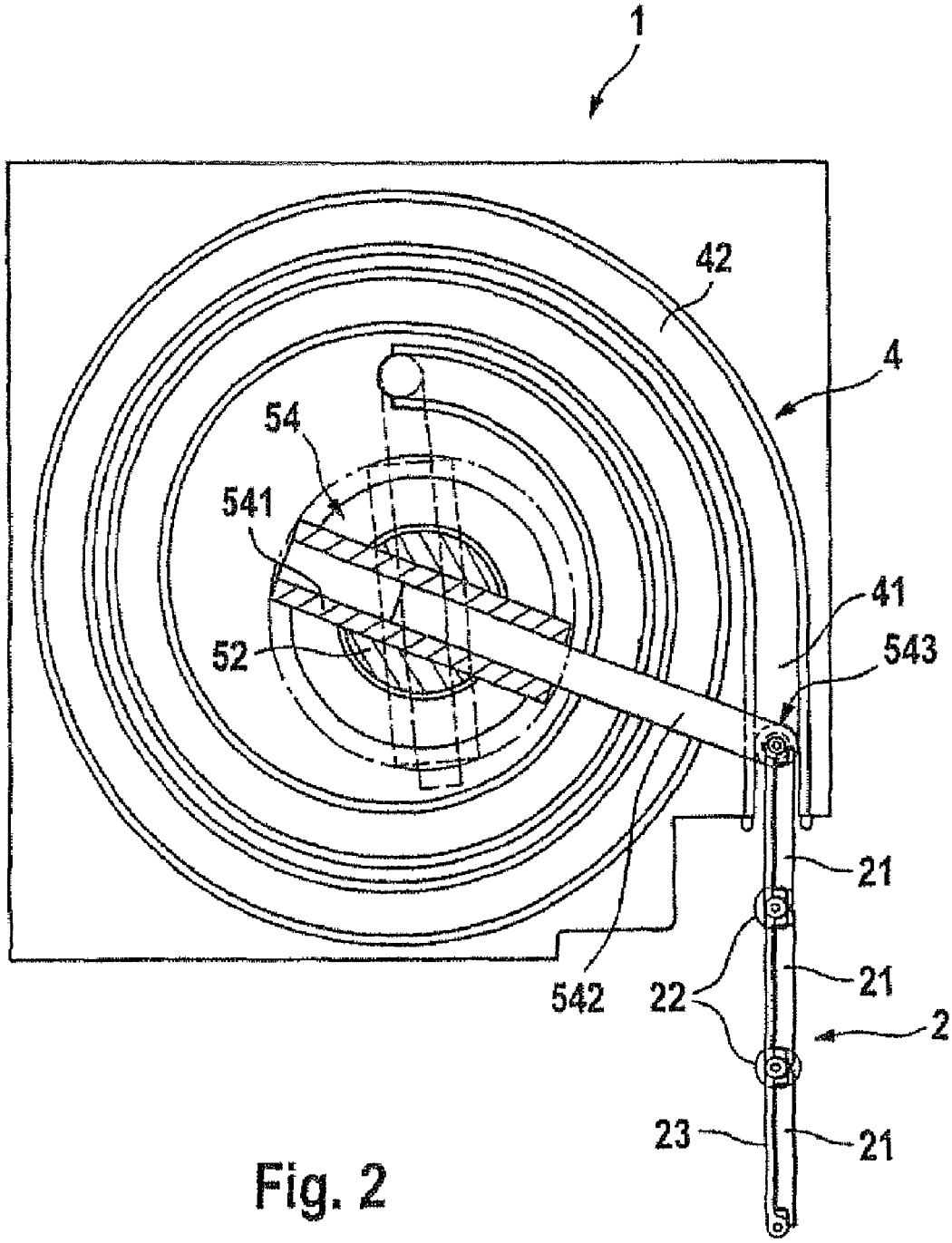
FIG. 2 is a schematic side view of a spiral section of a first embodiment of the industrial roller door according to the invention.

The guides 3 and 4 each have a vertical section 31 and 41, respectively, the upper end of which can be seen in FIG. 2, said vertical section 31 and 41, respectively, extending from the lintel-side end which is shown as far as the floor-side end of the roller door 1 in a conventional way but this, along with the frames, is not shown in more detail in the figures. On the lintel side the vertical sections 31 and 41 each open into a spiral section 32 and 42, respectively, which is in the form of a round spiral and in which the door leaf 2 is accommodated in the open position of the roller door 1 in such a way that the individual lamellas 21 are placed in a spiral-shaped roll without contact with one another.

The movement of the door leaf 2 between its end positions is brought about by a drive 5. The latter has a motor 51, here a winding motor, which is accommodated in the vicinity of a lateral frame in the vicinity of the door lintel and is directly coupled there to a drive shaft 52. The drive shaft 52 engages through the spiral section 32 and 42, respectively, of the guides 3 and 4, respectively, in a central area. The extension arms 53 and 54 are arranged on the drive shaft 52 on each side of the door opening, in each case adjacent to the spiral section 32 and 42, respectively. The extension aims 53 and 54 each engage centrally through the drive shaft 52 and protrude radially from it.

Figure 3:
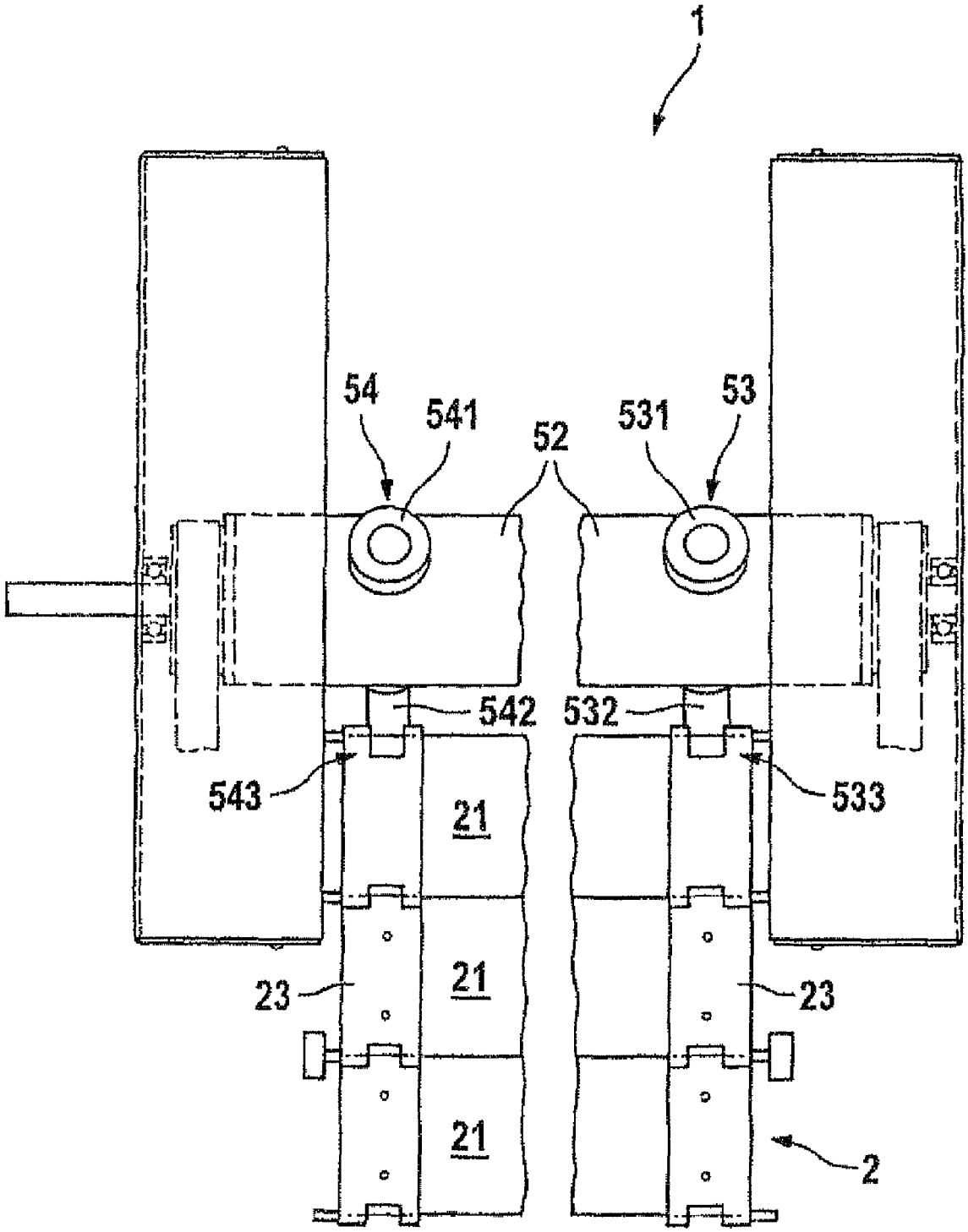
FIG. 3 is a schematic front view in the vicinity of the drive shaft on the first embodiment of the industrial roller door according to the invention.

As is apparent in particular from FIGS. 2 and 3, each extension arm 53 and 54, respectively, has a guide part 531 and 541, respectively, which is fixedly connected to the drive shaft 52. A piston part 532 and 542, respectively, is held in a positively locking fashion in each guide part 531 and 541, respectively, and is freely displaceably guided therein. One end of the piston part 532 and 542, respectively, which is positioned spaced apart from the guide part 531 and 541, respectively, and has a coupling point 533 and 543, respectively, by means of which each extension arm 53 and 54, respectively, is connected in an articulated manner to the lintel-side end of the door leaf 2. For this purpose, an element which extends over the entire width of the door (a lamella 21 in this first embodiment here) is present at the lintel-side end of the door leaf 2, as a result of which the drive force is transmitted uniformly over the width of the door leaf.

The roller door 1 is activated as follows:

FIGS. 2 and 3 show the state in which the roller door 1 is in its closed position, that is to say the door leaf 2 completely covers the door opening. In order to open the roller door 1, the motor 51 is activated in such a way that it transmits a rotational movement to the drive shaft 52 by means of which the door leaf 2 is moved upward into the spiral section 32 and 42, respectively. For this purpose, the rotational movement of the drive shaft 52 is applied to the lintel-side end of the door leaf 2 via the extension arms 53 and 54 and the coupling points 533 and 543. According to the illustration in FIG. 2, each extension aim 53 and 54, respectively, is rotated in the counterclockwise direction for this purpose. With this rotational movement, the door leaf 2 is drawn into the spiral section 32 and 42, respectively, and as the opening movement of the door leaf 2 progresses said door leaf 2 forms the spiral winding in the door lintel area.

Owing to the spiral shape of the lateral guides 3 and 4, respectively, in the door lintel area, the distance between the pivoting axis of the extension arms 53 and 54, which pivoting axis coincides with the rotational axis of the drive shaft 52, and the coupling points 533 and 543 on the extension arms 53 and 54, respectively, changes. This change in length is compensated automatically by the specific configuration of the extension arms 53 and 54 since each piston part 532 and 542, respectively, is held in a sliding fashion in the guide part 531 and 541, respectively.

In the open position of the roller door 1, the extension arms 53 and 54, respectively, are in the position shown by dashed lines in FIG. 2, from which it is apparent that their effective lever length has become significantly reduced compared to the initial state which is indicated. As is also apparent from FIG. 2, the length of the piston part 532 and 542, respectively, is selected here in such a way that in the state in which it is inserted to a maximum degree into the guide part 531 and 541, respectively, it does not protrude beyond the other end of the associated guide part to such an extent that it comes into conflict with a winding of the door leaf 2 in the spiral section 32 and 42, respectively.

As is apparent from this explanation, the maximum lever arm length on the extension arms 53 and 54 is present at the start of the opening movement. In order to keep the stresses which occur here on the drive 5, the roller door 1 has a weight compensation device (not illustrated in FIGS. 1 to 3) which is embodied in a conventional way in this embodiment. Said weight compensation device supports the drive 5 particularly at the start of the opening movement owing to the spring prestress of said weight compensation device so that the forces which have to be applied by the drive 5 are comparatively small. The drive forces can be reduced further by virtue of the fact that the length of the door leaf 2 is selected such that in the closed position of the door leaf 2 the coupling points 533 and 543 are present at the entry to the spiral section 32 and 42, respectively, and the extension arms 53 and 54, respectively, no longer have an angle of attack (illustrated in FIG. 2) of more than 90° with respect to the door leaf 2 but rather are positioned in all movement areas essentially perpendicularly to the assigned lintel-side end of the door leaf 2.

Figure 4:
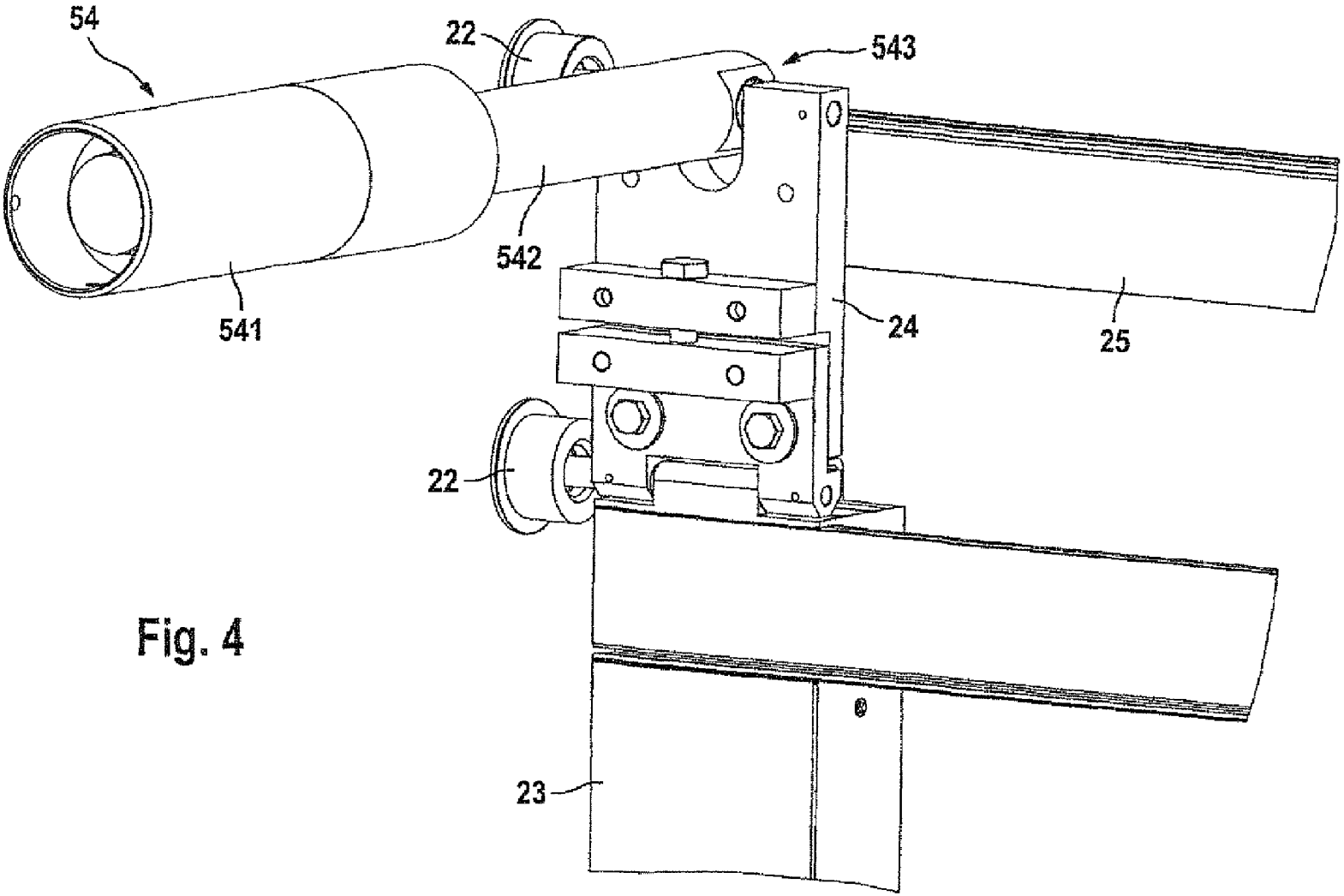
FIG. 4 is a perspective view of the coupling point of an extension arm to the door leaf according to a second embodiment.
Figure 5:
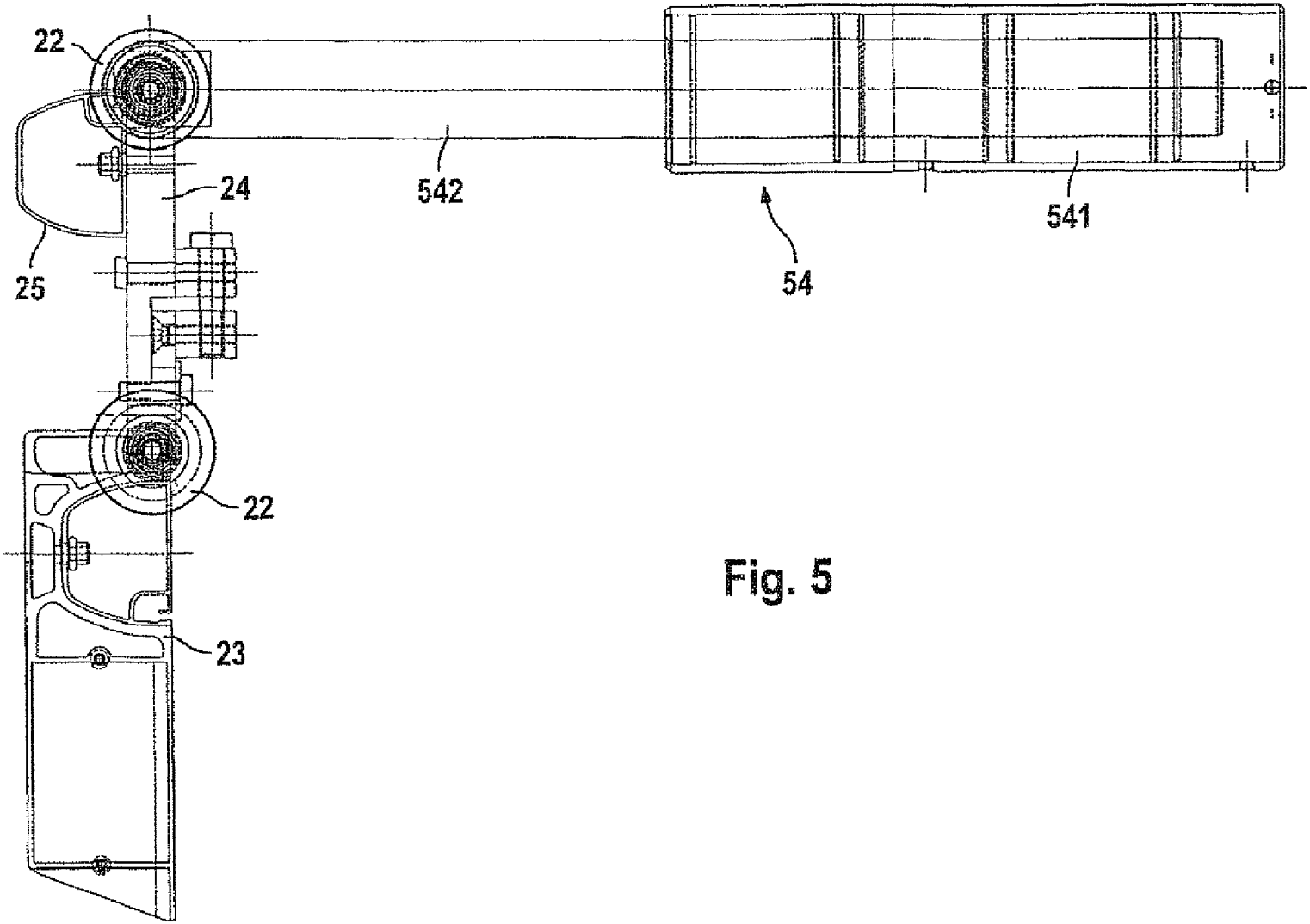
FIG. 5 is a side view of the arrangement according to FIG. 4.

FIGS. 4 and 5 show a second embodiment of the present invention which differs from the first embodiment in particular in the method of coupling the extension arms 53 and 54, respectively, to the door leaf 2. Components of the roller door 1 which correspond to those in the first embodiment are denoted by the same reference number.

As is apparent from the illustrations in FIGS. 4 and 5, the hinge belts 23, of which only one is shown in these figures, are provided at the lintel-side end with an end section 24 to which the extension arm 54 which is shown here is rotationally coupled via a joint. In this embodiment, the two end sections 24 are connected to one another over the entire width of the door by means of a lateral strut 25. In addition, a roller 22 is also mounted thereon.

This refinement according to this second embodiment ensures, even without lengthening of the door leaf, that the extension arms 53 and 54, respectively, are positioned at an angle of attack of 90° with respect to the door leaf 2, as is shown by FIG. 5. The drive forces for the application of the movement of the door leaf 2 are therefore also small in the closed position since the extensions arms 53 and 54, respectively, are also essentially perpendicular to the assigned lintel-side end of the door leaf, specifically the end sections 24, in this starting position.

In addition, the end sections 24 are of multi-part design so that they can be adjusted in length viewed in the direction of movement of the door leaf 2. This permits tolerance compensation in order to prevent oblique positioning of the door leaf 2 in the lateral guides 3 and 4. In the embodiment shown this is made possible by an adjustable screw connection.

A farther embodiment of a roller door 1 is explained below with reference to FIGS. 6 to 13, said roller door 1 being embodied as a lifting door and being provided with a weight compensation device 6. Components of the roller door 1 which correspond to those in the first embodiment or in turn denoted by the same reference number, and these features are not explained in detail in order to avoid repetitions.

Figure 6:
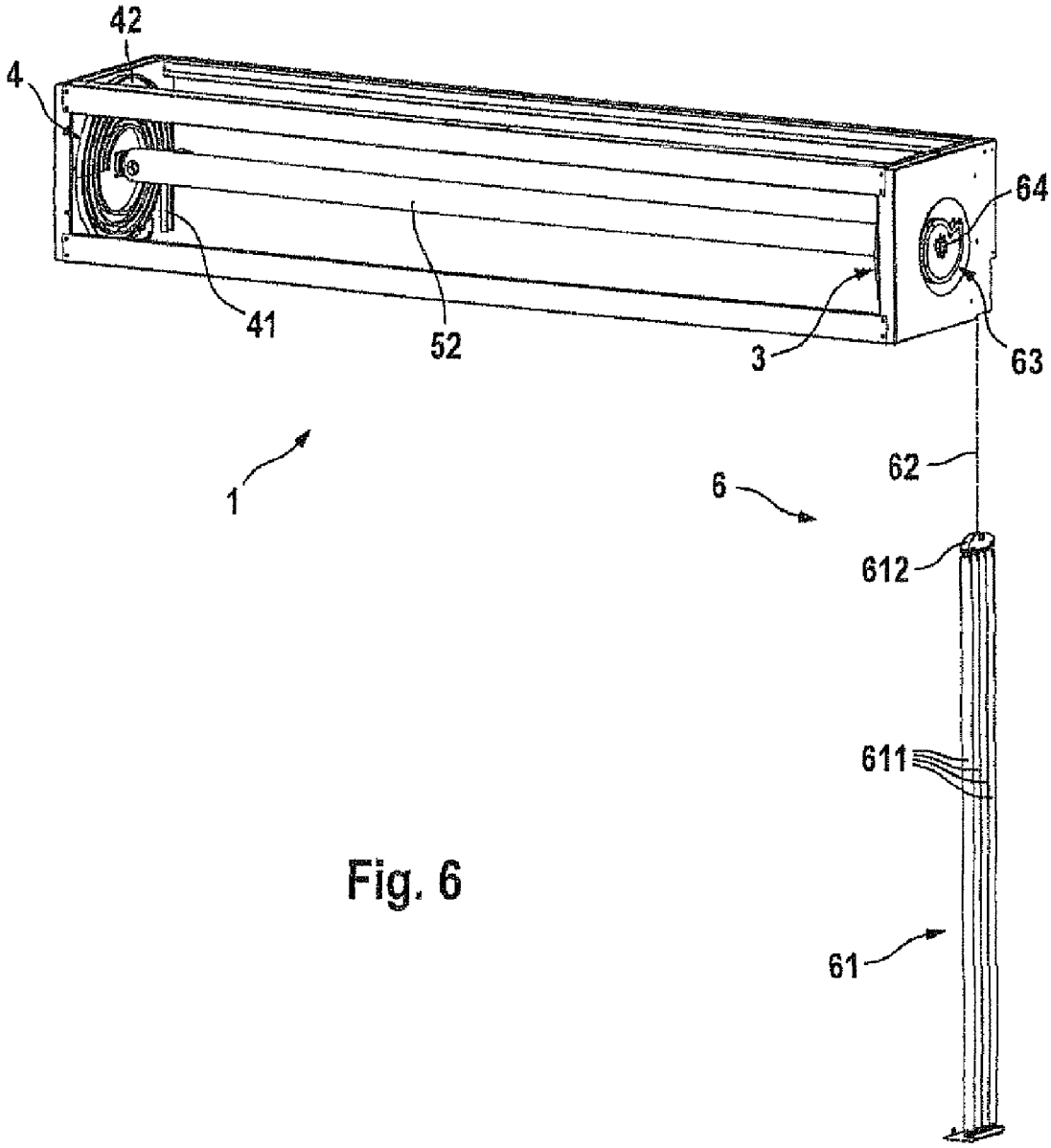
FIG. 6 is a perspective view of a lifting door which is equipped with a weight compensation device, in which the door leaf and further components of the lifting door are omitted for the sake of clarity.
Figure 7:
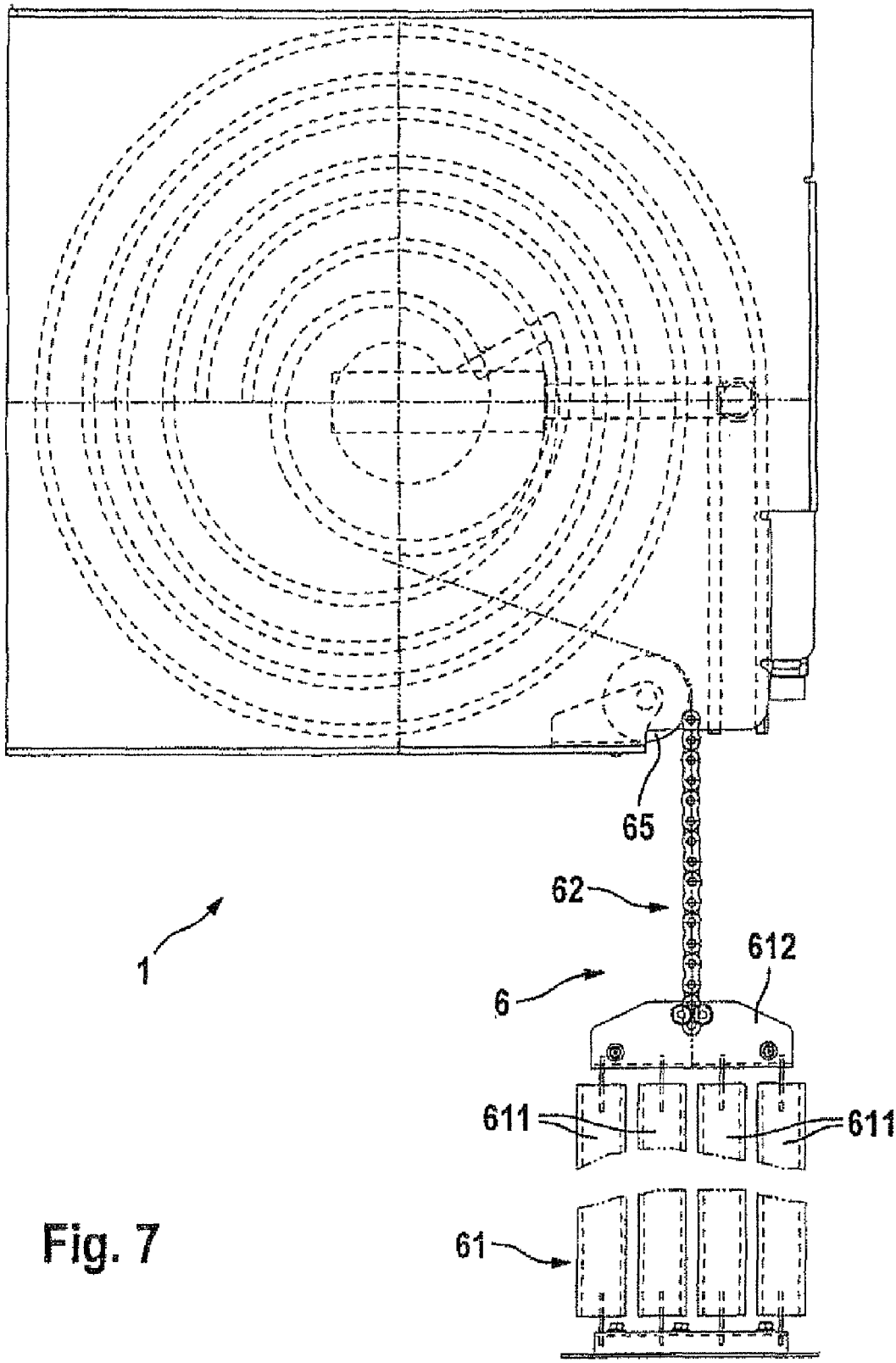
FIG. 7 is a side view of the lifting door according to FIG. 6 in which the door leaf is also omitted.
Figure 8:
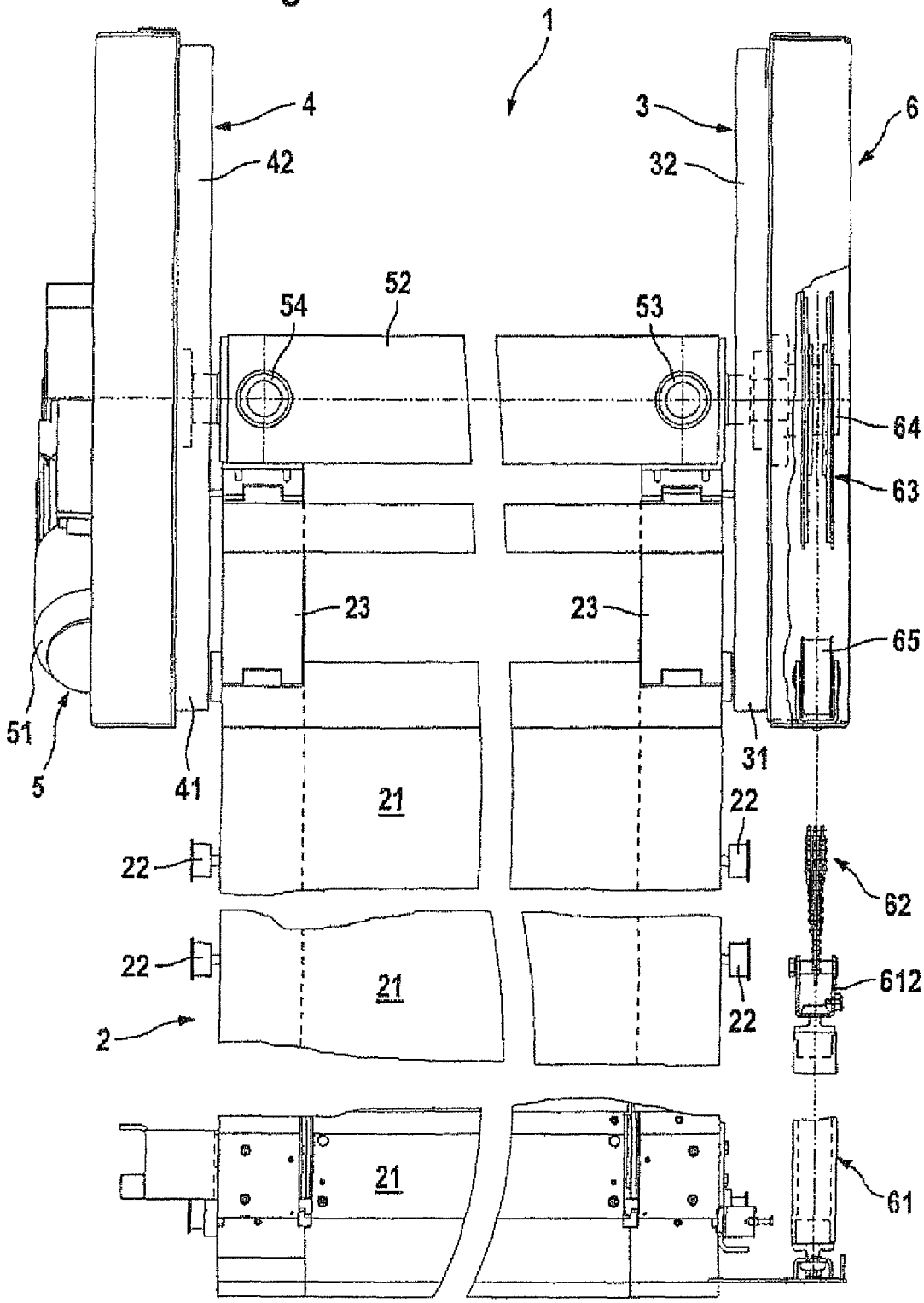
FIG. 8 shows a front view of the lifting door according to FIG. 6.

As is apparent from FIGS. 6 to 8, the lifting door 1 has a weight compensation means 6 which contains a spring element 61, a tensile element 62 and a winding device which has a guide device 63 and a shaft 64. The guide device 63 is mounted here on the shaft 64. As is also apparent from the figures, the shaft 64 is coupled directly to the drive shaft 52 and also rotates with it when the motor 51 is activated.

In the present embodiment, the spring element 61 has four helical springs 611 which are secured to the floor. By their other end, the helical springs 611 are fixedly connected by means of a strap 612 to the tensile element 62 which is embodied here as a chain. The lintel-side end of the tensile element 62 is deflected about a deflection roller 65 in the vicinity of the door lintel and is attached to the guide device 63.

The guide device 63 is shown in more detail together with the tensile element 62 in FIGS. 9 to 12. As is apparent in particular from FIGS. 7 and 8, the tensile element 62 is wound up in a contact free manner by means of the guide device 63 in the course of the closing movement of the door leaf 2. The tensile element 62 is secured here to the guide device 63 at an attachment point 66 and in the wound up state it extends according to the dash-two-dot lines 67 in FIG. 7, which line describes the center of the chain run.

As is apparent from FIGS. 9 to 12, the guide device 63 has an inner guide section 631 which has a first outer guide section 632 and a second outer guide section 633. The guide sections are embodied here in such a way that on the circumference they have guide faces with a radius which increases continuously in the winding direction. In addition, the two outer guide sections 632 and 633 are embodied as a disk pair 632*a* and 632*b* as well as 633*a* and 633*b* which each enclose the inner guide section 631 axially. The second outer guide section 633 also encloses the first outer guide section 632 axially.

Furthermore, the maximum guide face radius of the inner guide section 631 corresponds to the minimum guide face radius of the first outer guide section 632 so that there is a continuous transition here. In the same way, the maximum guide face radius of the first outer guide section 632 is configured to correspond to the minimum guide face radius of the second outer guide face 633.

As is apparent in particular from FIG. 12, the tensile element 62 is embodied here in such a way that it has an increasing width from its lintel-side end in the direction of the floor-side end. In the present exemplary embodiment, the tensile element 62 has here three different widths corresponding to the number of guide sections. In FIG. 11, the state in which the chain comes to rest on the guide sections of the guide device 63 is shown in section for the sake of clarity. From this it is apparent that the tensile element 62 is therefore wound up in a contact free manner in the guide device 63 without axial displacement with respect to the shaft 64.

For this purpose, the width of the tensile element 62 is selected at the lintel-side end in such a way that this section 62*a* can be wound up directly onto the inner guide section 631. A second section 62*b* of the tensile element 62 with an average width corresponds to the width of the first outer guide section 632 so that this section 62*b* of the tensile element 62 is wound up on its guide faces. Correspondingly, the width of a subsequent widened section 62*c* of the tensile element 62 is adapted to the width of the second outer guide section 633 so that it comes to rest on its guide faces. As a result of the adaptations of the radii of the individual guide sections 631 to 633 which are explained above a continuous transition is produced in the course of the winding process, i.e. uniform winding up of the tensile element 62 occurs during the closing movement of the door leaf 2.

Figure 13:
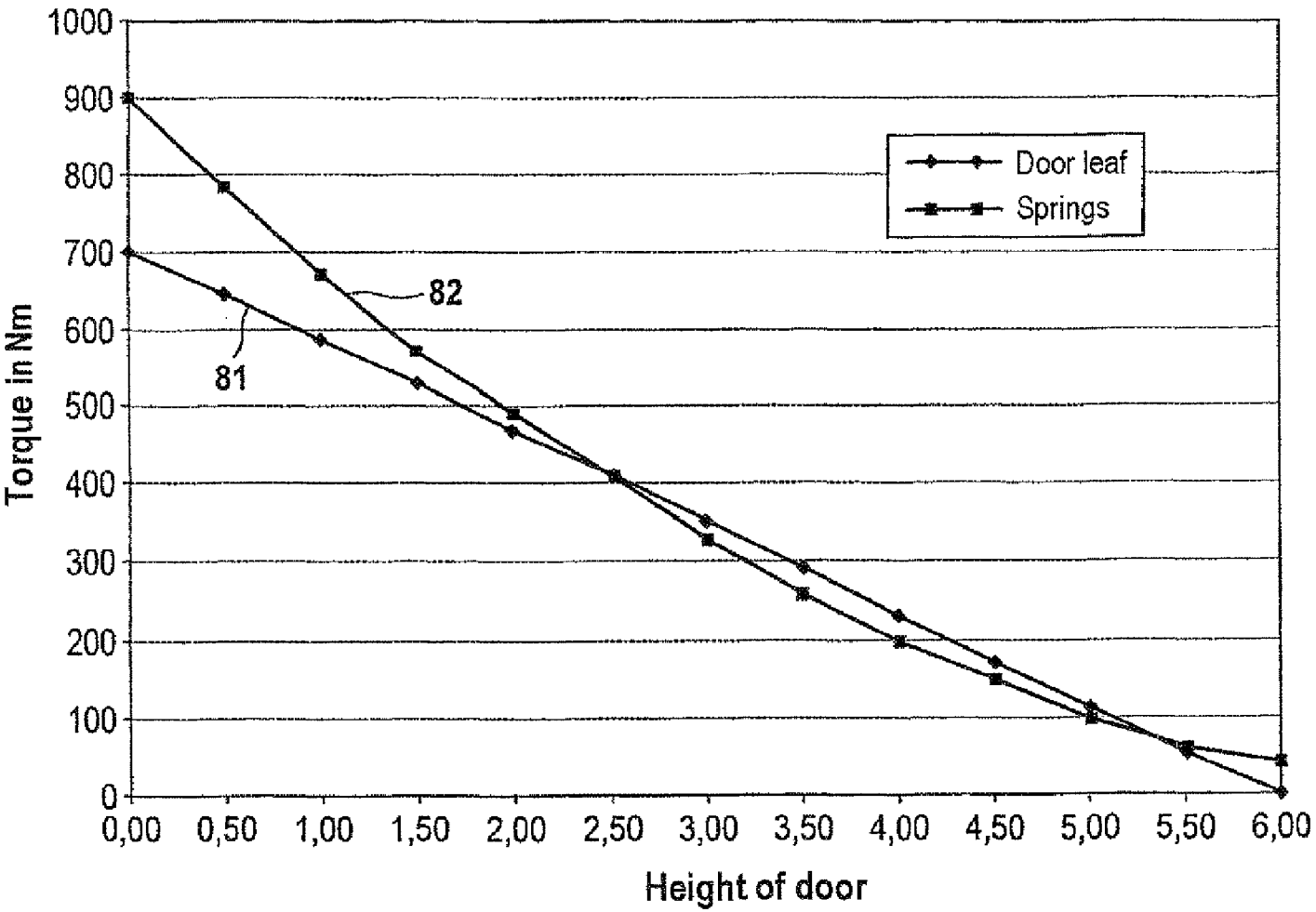
FIG. 13 shows the characteristic of the weight compensation device.

FIG. 13 is a schematic illustration of the characteristic of the weight compensation device 6 by means of characteristic curves. Here, an exemplary door height of 6 m is shown, the clear height of the remaining door opening being plotted on the right. The value "0.00" therefore stands for the complete closed lifting door 1, while the value "6.00" stands for the completely opened lifting door 1. In the upward direction, the torque acting on the drive shaft 52 on the basis of the weight of the free door leaf section is indicated with a characteristic curve 81 through the lozenges while the torque acting on the drive shaft 52 as a result of the weight compensation device 6 is given by means of a characteristic curve 82 which runs through the squares. Said curve indicates the torque which is brought about by the spring element 61.

As is apparent from FIG. 13, the weight compensation device 6 is set in such a way that when the door is closed the spring element 61 is expanded to such an extent that a torque of approximately 200 Nm, which is in excess of the torque produced by the gravitation force of the door leaf, is present. This ensures that when the closed lifting door 1 is activated the door leaf 2 can move upward, even without an additional drive, to approximately the height at which the gravitational force of the free door leaf section is in equilibrium with the applied spring force of the spring element 61. According to FIG. 13, this is a point at which the two lines intersect, i.e. at a height of approximately 2.5 m.

When the door leaf opens further, the respectively necessary drive torque is virtually in equilibrium with the torque which is made available by the weight compensation device 6 so that the drive 5 must essentially only counteract the existing frictional forces.

When the door is completely opened, the torque which is made available by the weight compensation device 6 in accordance with the illustration in the diagram in FIG. 13 exceeds the torque which is produced at the drive shaft 52 as a result of the gravitational force of the door leaf 2 so that the door leaf is reliably prevented from dropping even if the drive 5 is defective.

In addition to the embodiments which are explained, the invention also permits further configuration approaches.

It is therefore also possible for the distance between the coupling points 533 and 543, respectively, of the extension arms 53 and 54, respectively, to the door leaf 2 and the pivoting axis of the extension aims 53 and 54, respectively, to be varied in a way other by means of telescopic configuration of the extension arms. For example, the extension arms may also have a predetermined length, in which case elements in the vicinity of the coupling point are then mounted on the extension arms in a longitudinally displaceable manner. Such an embodiment is conceivable in particular if the extension arms are arranged outside the guides 3 and 4 for the door leaf 2 viewed in the width of the door, and if the coupling element engages through the spiral section 32 and 42, respectively. In this case, the overall length of the extension arms is of a secondary importance since they cannot collide with wound parts of the door leaf 2 which are wound in the spiral section 32 and 42, respectively.

The extension arms can also be configured so as to be telescopic in a double or multiple manner. This permits in particular the overall length of the piston part to be reduced, allowing possible conflicts with wound parts of the door leaf 2 in the open position to be avoided even more satisfactorily.

In addition it is also possible for three, four or more extension arms to be provided for the drive of the roller door. This could be the case, in particular, if relatively large door widths of six meters or more are provided.

Furthermore it is also not necessary for the piston part to be guided in a freely displaceable manner in the tubular guide part. Controlled guidance would also be possible here. In addition, it is also not necessary for the guide part to be of tubular design but rather it may also have a polygonal cross-sectional shape, possibly open on one side, as long as the piston part is reliably guided therein and held in a positively locking fashion. The cross-sectional shape of the guide part and respectively of the piston part guided therein does not have to be embodied so as to be circular or polygonal in a specific way. An oval embodiment of the cross section or a combination of different cross-sectional shapes is also possible.

In addition, the extensions 53 and 54, respectively, do not have to be arranged on a common drive shaft either, and instead drive shaft sections which are mounted coaxially with respect to one another may also be positioned on each side of the door opening, with an extension arm coupled to each of them. The weight compensation device 6 can be mounted on a separate bearing shaft.

Furthermore it is also possible that the motor 51 does not drive the drive shaft 52 or the drive shaft sections and/or the weight compensation device 6 directly but rather indirectly via toothed belts, chains, gear mechanisms etc. However, for the sake of the most compact arrangement possible a direct drive of these components is to be preferred.

Furthermore, for the roller door 1 according to the invention it is essentially irrelevant what type of door leaf 2 is present. The application of force to the lintel-side end of the door leaf 2 which is provided according to the invention can be applied equally well to slatted armors, flexible curtains which are extended across the frame, door leaves such as in DE 102 36 648 A1 etc. Depending on the type of door leaf 2 and/or the field of application of the roller door 1 it may also be possible in this context to dispense with the lateral guide rollers 22 on the door leaf 2 and to simply guide them in a sliding fashion. This is advantageous in particular for applications of the roller door 1 in clean rooms, in the pharmaceutical industry etc. since it can be kept clean more satisfactorily.

In addition it is also possible to use such a weight compensation device in all the embodiments explained. In addition, such a weight compensation device can also be arranged in both lateral frames. In particular in the case of door leaves with relatively large widths such a weight compensation device may be advantageous for the purpose of reducing one-sided stresses on the arrangement.

The number of helical springs 611 of the spring element 61 is determined according to the given loads, i.e. in particular according to the type of door leaf, its weight and its dimensions. Furthermore it is also possible to provide other spring-elastic elements, such as for example extendible belts etc., instead of helical springs.

The tensile element 62 does not have to be configured as a chain but rather can also be provided in the form of a belt. A dimensionally stable material such as, in particular, a metal is to be preferred for this.

The number of guide sections on the guide device 63 depends on the length of the tensile element 62 and therefore indirectly on the height of the door. Accordingly, more or fewer than the described three guide sections may also be provided.

In addition it is also possible to use one guide device which has two guide spirals which, starting from a central section, extend with an increasing radius axially further away from one another toward the outside. This embodiment is suitable in particular in conjunction with a tensile element which increases in width continuously or at least virtually continuously from the end facing the winding device to the end facing the spring element and which can be wound thereon in a directly contactless manner and free of axial offset. In this embodiment, the tensile element is preferably embodied as a belt.

In addition it is not absolutely necessary to provide the transverse rods 25 in accordance with the second embodiment since the transverse rod arrangement which is provided by means of the top lamella of the door leaf 2 is frequently sufficient.

Tolerance compensation through adjustment of the distance between the door leaf and the coupling points of the extension arms can also be carried out in another way than through the multi-part end sections 24. In particular, other devices can also perform this function if such end sections are not to be provided in an embodiment.

What is claimed is:

1. A high-speed industrial roller door having a door leaf which covers the door opening and which is guided in lateral guides, a drive which acts on the door leaf in order to move it from an open position into a closed position and vice versa, wherein in the open position the door leaf is accommodated in a spiral section, arranged in the vicinity of the door lintel, of the lateral guides in such a way that adjacent areas of the door leaf are not in contact with one another, and having a weight compensation device, wherein the drive has at least two extension arms, each having one end thereof rotationally coupled which it is coupled in an articulated manner to a lintel-side end of the door leaf, wherein the extension arms are arranged spaced apart from one another in the width of the door and can be pivoted synchronously about a pivoting axis in a central area of the spiral section, and wherein the distance between rotational coupling points of the extension arms on the door leaf and the pivoting axis of the extension arms is automatically varied as the door leaf is moved between it's open and closed positions.

2. The industrial roller door as claimed in claim 1, wherein the extension arms are telescopic.

3. The industrial roller door as claimed in claim 2, wherein the telescopic extension arms each contain a tubular guide part and a piston part which is guided therein in a freely displaceable manner.

4. The industrial roller door as claimed in claim 1, wherein the extension arms are arranged on a common drive shaft which is driven in rotation by a motor of the drive.

5. The industrial roller door as claimed in claim 4, wherein the motor drives the drive shaft directly.

6. The industrial roller door as claimed in claim 1, wherein the extension arms are coupled to an element which extends over the entire width of the door.

7. The industrial roller door as claimed in claim 1, wherein the door leaf has two lateral hinge belts which are each arranged adjacent to the guides, and wherein the extension arms are each coupled to lintel-side end sections of the hinge belts.

8. The industrial roller door as claimed in claim 7, wherein the lintel-side end sections of the hinge belts can be adjusted in length viewed in the direction of movement of the door leaf.

9. The industrial roller door as claimed in claim 1, wherein:

the weight compensation device has a spring element, a tensile element and a winding device, one end of the spring element can be secured to the floor, the tensile element is attached by one end to the spring element and by the other end to the winding device, the winding device can be coupled to a drive of the lifting door, the tensile element can be wound onto the winding device and unwound from it in such a way that the spring element has its highest degree of prestress when a door leaf of the lifting door is in the closed position, and is essentially relieved of stress when the door leaf is in the open position, the tensile element has a smaller width at the end facing the winding device than at the end facing the spring element, and the winding device has a shaft and a guide device which is mounted thereon and by means of which the tensile element can be wound up in such a way that the winding layers are not in contact with one another, and wherein, for this purpose, the guide device has, on the circumference, guide faces with a radius which increases continuously in the winding direction.

10. The industrial roller door as claimed in claim 9, wherein the width of the tensile element increases incrementally from the end facing the winding device to the end facing the spring element, and the guide device has at least two guide sections which are each embodied in the form of a spiral and are offset axially with respect to one another in such a way that an outer guide section pair whose minimum guide face radius corresponds to the maximum guide face radius of the inner guide section adjoins an inner guide section.

11. The industrial roller door as claimed in claim 9, wherein the width of the tensile element increases continuously from the end facing the winding device to the end facing the spring element, and the guide device has two guide spirals which, starting from a central section, extend axially further apart from one another toward the outside with an increasing radius.

12. The industrial roller door as claimed in claim 9, wherein the tensile element is a chain.

13. The industrial roller door as claimed in claim 9, the tensile element is a belt.

14. The industrial roller door as claimed in claim 9, wherein the spring element has at least one helical spring.

15. The industrial roller door as claimed in claim 9, wherein the guide device is mounted on the drive shaft on which the extension arms are arranged.

* * * * *

UNITED STATES PATENT AND TRADEMARK OFFICE

CERTIFICATE OF CORRECTION

PATENT NO. : 7,913,739 B2
APPLICATION NO. : 12/089815
DATED : March 29, 2011
INVENTOR(S) : Gabrijel Rejc et al.

It is certified that error appears in the above-identified patent and that said Letters Patent is hereby corrected as shown below:

In Column 3, Line 64, delete “airs.” and insert -- arms. --, therefor.

In Column 4, Line 14, delete “firm” and insert -- from --, therefor.

In Column 4, Lines 54-59, delete “By virtue of.....at high speed.”.

In Column 6, Line 35, delete “alms” and insert -- arms --, therefor.

In Column 7, Line 2, delete “all” and insert -- an --, therefor.

In Column 9, Line 52, delete “of” and insert -- of, --, therefor.

In Column 11, Line 13, delete “aims” and insert -- arms --, therefor.

In Column 11, Line 43, delete “aim” and insert -- arms --, therefor.

In Column 12, Line 54, delete “farther” and insert -- further --, therefor.

In Column 16, Lines 23-24, delete “coupled which it is coupled in an articulated manner” and insert -- coupled --, therefor.

Signed and Sealed this
Fourteenth Day of June, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,913,739 B2
APPLICATION NO. : 12/089815
DATED : March 29, 2011
INVENTOR(S) : Rejc et al.

It is certified that error appears in the above-identified patent and that said Letters Patent is hereby corrected as shown below:

On the title page, under (75) Inventors, change the city of residence for Mr. Sentjurc (second-named co-inventor) from "Velen" to -- Velenje --.

Under (73) Assignee, change the country code from "(SK)" to -- (SI) --.

Signed and Sealed this
Twenty-seventh Day of September, 2011

David J. Kappos

David J. Kappos
*Director of the United States Patent and Trademark Office*